US011371287B2

(12) United States Patent
Välisalo

(10) Patent No.: US 11,371,287 B2
(45) Date of Patent: Jun. 28, 2022

(54) FLUID OPERATED DRILLING DEVICE AND A METHOD FOR DRILLING A HOLE

(71) Applicant: PIRKAN LAATUPALVELU OY, Pirkkala (FI)

(72) Inventor: Juhani Välisalo, Pirkkala (FI)

(73) Assignee: PIRKAN LAATUPALVELU OY, Pirkkala (FI)

( * ) Notice: Subject to any disclaimer, the term of this patent is extended or adjusted under 35 U.S.C. 154(b) by 323 days.

(21) Appl. No.: 16/640,315

(22) PCT Filed: Aug. 21, 2018

(86) PCT No.: PCT/FI2018/050592

§ 371 (c)(1),
(2) Date: Feb. 19, 2020

(87) PCT Pub. No.: WO2019/038474

PCT Pub. Date: Feb. 28, 2019

(65) Prior Publication Data

US 2020/0270949 A1 Aug. 27, 2020

(30) Foreign Application Priority Data

Aug. 21, 2017 (FI) ..... 20175742

(51) Int. Cl.
*E21B 6/04* (2006.01)
*E21B 1/38* (2006.01)
(Continued)

(52) U.S. Cl.
CPC ..... *E21B 6/04* (2013.01); *E21B 1/38* (2020.05); *E21B 34/06* (2013.01); *E21B 7/02* (2013.01)

(58) Field of Classification Search
CPC ..... E21B 4/14; E21B 1/26; E21B 1/36; E21B 6/04
See application file for complete search history.

(56) References Cited

U.S. PATENT DOCUMENTS 3,095,046 A 6/1963 Mori
4,591,004 A 5/1986 Gien
(Continued)

FOREIGN PATENT DOCUMENTS

AU 647604 B2 3/1994
AU 688311 B2 3/1998
WO 2012056434 A1 5/2012

OTHER PUBLICATIONS

International Search Report in related International Application No. PCT/FI2018/050592, dated Feb. 28, 2019, 5 pages.
(Continued)

*Primary Examiner* — Shane Bomar
(74) *Attorney, Agent, or Firm* — FisherBroyles, LLP; Robert Kinberg

(57) ABSTRACT

A fluid operated drilling device for drilling a hole includes a hammer connected to a drill rod, and a rotation device to rotate the drill rod and the hammer. The hammer includes a tubular main body, a back head, a cylindrical piston housing, a reciprocating piston and a space between the piston. The piston housing is divided by an annular pressurizing portion into first and second space portions for elevating and striking the piston. First communication channels from a hollow portion of the piston into a second space between the piston and the main body discharge fluid between the piston and the main body. A method for drilling a hole using the fluid operated drilling device is also disclosed.

20 Claims, 10 Drawing Sheets

(51) Int. Cl.
*E21B 34/06* (2006.01)
*E21B 7/02* (2006.01)

(56) References Cited

U.S. PATENT DOCUMENTS

| | | | | | |
|---|---|---|---|---|---|
| 5,488,998 | A * | 2/1996 | Ekwall | B25D 17/06 | 173/132 |
| 5,662,180 | A * | 9/1997 | Coffman | E21B 4/00 | 173/112 |
| 5,803,188 | A | 9/1998 | McInnes | | |
| 6,047,778 | A * | 4/2000 | Coffman | E21B 4/00 | 173/205 |
| 10,316,586 | B1 * | 6/2019 | Aros | E21B 4/14 | |
| 2003/0230430 | A1 * | 12/2003 | Martini | E21B 4/10 | 175/57 |
| 2007/0261869 | A1 | 11/2007 | In | | |
| 2014/0076638 | A1 | 3/2014 | Aros | | |
| 2018/0073300 | A1 * | 3/2018 | Cooper | E21B 7/046 | |
| 2020/0347678 | A1 * | 11/2020 | Välisalo | E21B 4/14 | |

OTHER PUBLICATIONS

Written Opinion in related International Application No. PCT/FI2018/050592, dated Feb. 28, 2019, 7 pages.
Finnish Search Report in related Finnish Patent Application No. 20175742, dated Mar. 21, 2018, 1 page.

* cited by examiner

SECTION H

SECTION G-G

FLUID OPERATED DRILLING DEVICE AND A METHOD FOR DRILLING A HOLE

CROSS-REFERENCE TO RELATED APPLICATIONS

The present application is a U.S. National Stage of International Patent Application No. PCT/FI2018/050592, filed Aug. 21, 2018, which claims the benefit of Finnish Patent Application No. 20175742, filed Aug. 21, 2017.

FIELD OF THE INVENTION

The invention relates to a fluid operated drilling device for drilling a hole, said drilling device having a hammer for creating the hole with a rotating and percussive motion, a rotation device for rotating the hammer and a drill rod connecting the rotation device to the hammer and transporting operating pressurized drill fluid to the hammer for creating the percussive motion of the hammer, the hammer comprising

- a tubular main body having a hollow interior and an upper end and a lower end;
- a back head, for connecting the hammer to the drill rod, coupled to an upper end of the main body and having a fluid pressure supply passage;
- a cylindrical piston housing connected to the main body;
- a reciprocating piston slidably installed in the piston housing, for impacting a drill bit of a bit unit installed at a lower end of the main body, the drill bit being movable for a predetermined length longitudinally relatively to the main body, the piston having a first end and a second end, the first end being closer to the drill rod than the second end, a hollow portion through which fluid is discharged, a first communication hole connected to the hollow portion and an annular pressurizing portion protruding on piston's outer circumferential surface,
- a space between the piston and the piston housing divided by the annular pressurizing portion extending in radial direction of the piston into first space portion for elevating the piston and second space portion for striking the piston;
- a valve unit for controlling fluid discharge from the second space portion through the first communication hole to the hollow portion, and;
- a fluid pressure supply unit for supplying high pressure fluid delivered to the fluid pressure supply passage of the back head alternatively to the first space portion and the second space portion;

wherein the rotation device is rotating the bit unit using the drill rod and the main body.

The invention also relates to a method for drilling a hole using a fluid operated drilling device.

BACKGROUND OF THE INVENTION

A fluid operated percussive hammer according to prior art is rotated by means of a drill rod for at least transporting operating pressurized drill fluid to a percussive unit for creating a percussive motion for drilling a hole in relatively hard formations or in mixture of hard and soft formations. In the hammer the same drilling fluid transports cuttings from the drill face and at least partially cleaning the drill hole. The drill rod is arranged to create a rotary motion to the percussive hammer that has a reciprocating piston, which impacts a drill bit attached on the percussive hammer and the impacting drill bit is able to move a certain predetermined length longitudinally relatively to the percussive hammer body. Water or drilling fluid may contain additives to increase its capacity to carry drilled waste material from the hole or assist to support the drill hole. The hammer includes a tubular main body having a hollow interior. The hammer has a back head connected with a drill pipe, which has at least a pressure fluid supply passage to transfer pressurized fluid to the percussive hammer. The percussive hammer has a percussive piston being capable to hit the percussive drill bit drilling the drill hole at its lower end portion.

Previously are known water hammers such as Wassara that have a valve as well as a bottom pressure chamfer lifting the piston to its elevated loading position and top chamfer driving the piston against the percussive drill bit cycle being controlled by a valve system on the top portion of the percussive hammer.

Prior art document US 20070261869 A1 discloses a water hammer where a valve system is primarily located at the top portion of the water hammer. The water hammer has a valve member forming first, second and third space portions creating the percussive motion of the water hammer. When using such construction and especially a piston with maximum diameter it is difficult to arrange flushing in a manner that will keep the components inside the hammer clean because there is practically no flushing inside the hollow portion of the tubular main body. Also, a large piston is moving relatively large volume of water back and forward, which reduces power, making it difficult to seal the hammer due to movement of large volumes of water back and forth which also contaminates the water hammer with drilling debris and fine pieces of rock and sand. This construction has a continuous hollow portion through the piston from one end of the piston to the other, which hollow portion effectively guides operating fluid out of the percussive unit, making it difficult to guide fluid through the hammer to effectively lubricate other parts in the system. In addition, all foreign particles in such a system are trapped within the water hammer as the hammer rotates and have no way out except through sealed areas, breaking seals in the process. This problem exists also in a construction where a moveable pressure shield is fitted in the lower portion of the water hammer to better accommodate movement and the suction of the mentioned oversized piston, which also creates a suction effect and elevates the suction of foreign material of the water hammer.

SUMMARY OF THE INVENTION

An object of the invention is to develop a fluid operated drilling device and a method for drilling a hole which minimizes the tendency for suction, and to create an economical way to produce a fluid operated percussive hammer with a valve portion on its top end. The purpose of the invention is also to create a drilling device and a method for drilling wherein any contamination entering into the percussive hammer is removed from within due to effective flushing of the main body's hollow interior towards the percussive drill bit. The invention is characterized by a fluid operated drilling device for drilling a hole, the drilling device having a hammer for creating the hole with a rotating and percussive motion, a rotation device for rotating the hammer and a drill rod connecting the rotation device to the hammer and transporting operating pressurized drill fluid to the hammer for creating the percussive motion of the hammer. The hammer comprises a tubular main body having a hollow interior, an upper end and a lower end, a back head, for connecting the hammer to the drill rod, coupled to an upper end of the main body and having a fluid pressure supply passage and a cylindrical piston housing connected to the main body. In addition, the hammer includes a reciprocating piston slidably installed in the piston housing, for impacting a drill bit of a bit unit installed at a lower end of the main body, the drill bit being movable for a predetermined length longitudinally relative to the main body. The piston has a first end and a second end, the first end being closer to the drill rod than the second end, a hollow portion through which fluid is discharged, a first communication hole connected to the hollow portion and an annular pressurizing portion protruding on the piston's outer circumferential surface. The hammer further includes a space between the piston and the piston housing divided by an annular pressurizing portion extending in a radial direction of the piston into a first space portion for elevating the piston and a second space portion for striking the piston. The hammer also includes a valve unit for controlling fluid discharge from the second space portion through a first communication hole to the hollow portion, a fluid pressure supply unit for supplying high pressure fluid delivered to the fluid pressure supply passage of the back head to the first space portion and the second space portion and a second space in the hollow interior of the main body between the piston and the main body in the radial direction of the piston and between the piston housing and the bit unit in the axial direction of the piston. The piston further includes first communication channels from the hollow portion of the piston into the second space for discharging the fluid between the piston and the main body. The rotation device is arranged to rotate the bit unit using the drill rod and the main body.

In the invention the second space can be used to lead discharged fluid outside the piston to lubricate the hammer and to flush out any debris inside the hammer. In addition, the pressurized first space portion and the second space portion within the piston housing are relatively small in volume decreasing the volume of pressurized operating fluid being transferred during percussive motion of the piston. The discharged fluid outside the piston may be used to fill the void between the piston and the drill bit created by the elevating piston so that fluid is not sucked into the hammer from the bore hole. This decreases the amount of debris going inside the hammer during drilling, increasing the service life of the hammer. Even if some debris gets inside the hammer, the discharged fluid flushes that debris out.

In this application relative terms such as "below", "upper" and "lower" refer to the hammer's normal using position on a flat surface. For example, "below" refers to a position closer to the drill bit.

According to an embodiment of the invention, the longitudinal length of the first space portion is 10-30%, preferably 20-25% of the length of the piston. Therefore, the second space below the piston housing is relatively large and not affected by the pressurized operating fluid, which means that a larger piston diameter may be used to increase the mass of the piston.

Preferably, the piston has a first diameter and a second diameter over a partial length of the piston between the piston housing and the bit unit outside the partial length, the portion of the piston with the first diameter being in contact with the bit and being smaller in diameter than the second diameter. The larger diameter may be used between support points of the piston in order to increase the mass of the piston.

Preferably, the piston has a lower part and an upper part detachably connected to each other. By making the piston from two separate parts, the parts are easier to manufacture and can be serviced separately.

Preferably, both the lower part and the upper part include the hollow portion, and the upper part has the first communication hole and the annular pressurizing portion and the lower part has the first communication channels connected to the hollow portion for leading discharged fluid between the piston and the main body and back inside the piston.

Preferably the first length L2 of the piston is 40-65% of the total length of the piston and the partial length is 10-25% total length of the piston. This means that the areas between the piston housing and the piston that need to be sealed for pressure, remain small in size.

According to an embodiment, the first space portion for elevating the piston and second space portion for striking the piston form piston reciprocating equipment located outside the first length L2 of the piston, which first length L2 is at the second end of the piston. Therefore, the piston housing can be relatively small in length.

Preferably, the piston housing is a single uniform part. A uniform part is easier to manufacture and to attach to the main tube.

The lower part and the upper part of the piston may be connected to each other with threads, lock pin or other suitable method that connects the lower part and the upper part as a solid structure in the longitudinal direction of the piston.

According to an embodiment, the lower part and the upper part of the piston are made of different materials. The parts may require different wear characteristics.

The axial direction of the first communication channels may be at an angle in relation to the hollow portion, the angle being 30-60°, preferably 40-50°, relative to the longitudinal direction of the piston. This kind of design reduces the pressure losses of the fluid.

Preferably, the hammer further includes a piston bearing in connection with a bit unit for supporting the piston and second communication channels arranged in the piston bearing to discharge fluid between the piston and the drill bit when the piston is elevated. The second communication channels provide an auxiliary passage for the discharged fluid to get between the piston and the drill bit in order to avoid the piston from sucking debris from outside the drill bit.

Preferably, the second space is excluded from the pressurized operating fluid and available only to discharged fluid. This enables the diameter of the lower part of the piston to be increased without losing effective surface area for the percussive motion of the piston.

Preferably, a majority of the mass of the piston is located on a partial length of the piston between the piston housing and the bit unit outside such partial length. Since the second space is available only to discharged fluid there is less resistance for movement of the heavier part of the piston.

Preferably, the drill bit includes shoulders or inserts arranged in the drill bit for impacting the ground during drilling. This makes it possible to use the drilling device for efficiently drilling holes into rock mass.

The piston may be arranged to cooperate with the valve unit for indicating the axial position of the piston relative to the valve unit. The removes the need for using sensors to indicate the axial position of the piston relative to the valve unit.

The hollow portion is preferably discontinuous through the piston and includes two consecutive parts, namely an upper flow channel and a lower exhaust channel, which are separated by a solid portion belonging to the piston. By using a discontinuous hollow portion, the discharged operating fluid may be used to flush the hollow interior and then be led back inside the piston to reduce the suction effect of the elevating piston.

Preferably, each part of the hollow portion has first communication channels for guiding the discharged fluid into the second space from the upper flow channel and back inside the piston in the lower exhaust channel closer to the bit unit for leading the discharged fluid to the bit unit.

The lower exhaust channel is preferably open to the bit unit. The operating fluid can then be led through the piston outside the hammer and the piston suction of the piston is reduced during elevation.

Preferably, the hollow portion of the piston is discontinuous through the piston and includes two consecutive parts which are separated by a solid portion belonging to the piston. Discharged fluid then flushes the main body's hollow interior effectively in order to flush out any debris from the hammer.

Each part of the hollow portion has first communication channels for guiding the discharged fluid into the hollow interior of the main body from the part of the hollow portion closer to the piston housing and back inside the piston in the part of the hollow portion closer to the bit unit.

The longitudinal length of the first space portion may be first—30%, preferably 20-25% of the length of the piston. This means that the space between the piston housing and the piston is relatively small in volume so that a fairly small amount of pressurized fluid is moved during percussive motion of the piston. The small size of the first space portion also forms the second space in the hollow interior of the main body below the piston housing and discharged fluid can be used to flush and lubricate this area.

Preferably, the piston housing extends only over a partial length of the piston forming the second space in the hollow interior of the main body. Thus, the second space can be relatively large and the space inside the piston housing relatively small.

The diameter of the piston may be between 100-900 mm, preferably 140-300 mm. The length of the hammer may be 1.0-4.0 m, preferably 1.5-2.5 m. The length of the first space portion may be 100-600 mm, preferably 150-200 mm.

The hammer may include a piston bearing hold for allowing fluid passage between the piston and the drill bit.

Preferably, the first communication channels include upper communication channels from the hollow portion of the piston into the second space for discharging the fluid between the piston and the main body, and lower communication channels from the second space into the hollow portion of the piston for discharging the fluid from the piston through the bit unit. To be more precise, the lower communications channels connect the hollow interior of the main tube to the lower exhaust channel of the piston. By using separate first communication channels the hollow space in the piston can be manufactured as a simple bore hole in the piston.

The invention is further characterized by a method for drilling a hole using a fluid operated drilling device, which method includes steps of pressurizing pressurized operating fluid with a fluid pressure supply unit, rotating a drill rod and a percussive hammer attached to the drill rod with a rotation device and leading pressurized operating fluid to a percussive hammer through the drill rod. The method further includes steps of using pressurized operating fluid in the percussive hammer to alternately elevate and impact a percussive piston by pressurizing a first space portion inside a piston housing to elevate the piston and a second space portion inside the piston housing to impact the piston to cause the percussive motion of a drill bit installed axially movably on the piston, and guiding operating fluid discharged from the first space portion and the second space portion outside the piston to flush and lubricate a second space between the piston and the main body of the hammer outside the piston housing. In addition, the method includes a step of guiding operating fluid discharged to the hollow interior back inside the piston before guiding the operating fluid through a ring bit.

By guiding discharged fluid outside the piston below the piston housing, any debris in the hollow interior of the main body of the hammer can be flushed out and the discharged fluid may be led to fill a void formed between the drill bit and the piston when the piston is elevated. The method facilitates keeping the inside of the hammer free of debris and therefore increases the service life of the hammer. When the operating fluid is then lead back inside the piston before being discharged out of the hammer through the ring bit, the suction effect of the elevating piston is reduced since the piston having a lower exhaust channel has a smaller surface area against the ring bit than pistons of prior art having a uniform body.

Preferably, since fluid is relatively incompressible, the percussive hammer has a valve unit controlling the percussive motion. The percussive piston preferably cooperates with the valve unit, indicating the valve unit axial position relative to the percussive piston.

Using the drilling device according to the invention makes it is easier to construct the valve unit from highly abrasion resistant materials, thus making it possible to operate with fluid containing a degree of abrasive particles such as drilling mud. With the help of one possible construction of the invention, it is possible to manufacture a percussive fluid or a mud hammer equipped with a heavy percussive piston at a reasonable cost yet possible to incorporate special materials and material treatment due to an impact loading point, which strikes the percussive drill bit, that is not connected to the valve unit during its manufacturing process.

BRIEF DESCRIPTION OF THE DRAWINGS

The invention is described below in detail by referring to the appended drawings that illustrate some of the embodiments of the invention, in which.

Figure 1:
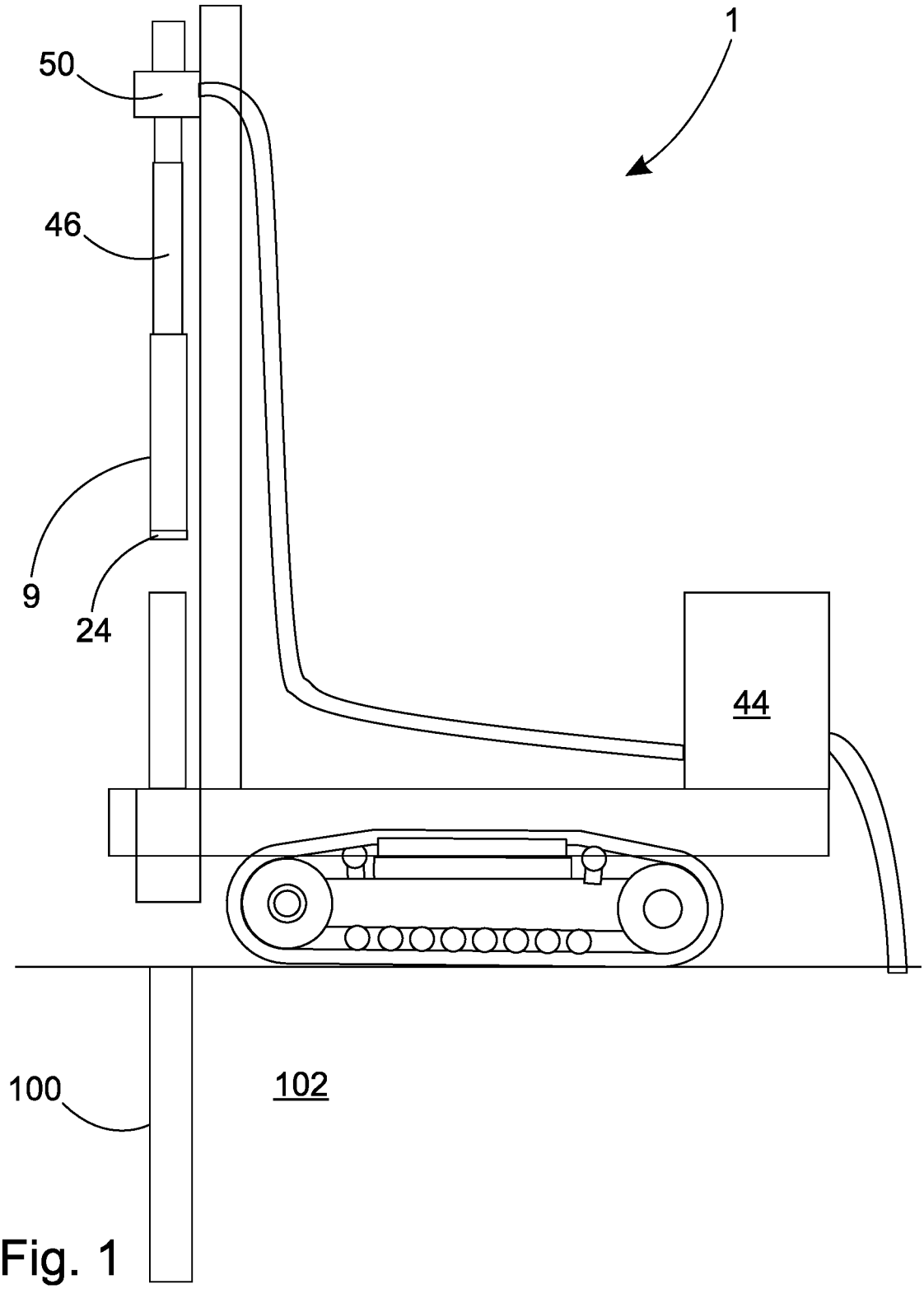
FIG. 1 is a side view of the drilling device according to the invention.

In the drawings the following reference numbers are used to indicate features illustrated in the drawings:

1 drilling device
9 percussive hammer
10 main tube
12 hollow interior
14 back head
16 upper end of the main body

18 fluid pressure supply passage
20 piston housing
21 braking chamber
22 piston
24 drill bit
26 bit unit
28 lower end of the main tube
30 hollow portion of the piston
32 annular pressurizing portion
34 first communication hole
36 piston's outer circumferential surface
38 space
40 first space portion
42 second space portion
44 fluid pressure supply unit
46 drill rod
48 first communication channels
49.1 upper first communication channels
49.2 lower first communication channels
50 rotation device
52 second communication channels
54 drill bit nut
56 male piston connection member
58 female piston connection member
60 lower part of the piston
62 upper part of the piston
64 bearing hold
66 piston upper seal
68 adapter
70 valve housing
72 main chamber of the valve unit
74 hydraulic braking shoulder
76 valve unit
78 jacket pipe
80 piston plug
82 first end of the piston
84 second end of the piston
85 upper flow channel
86 piston guide bearing
87 lower exhaust channel
88 parts of hollow portion of the piston
90 solid portion
92 third communication channel
94 second fluid pressure supply passage
96 thread
98 part of valve unit
100 hole
102 ground

DETAILED DESCRIPTION OF THE INVENTION

According to FIG. 1, the drilling device 1 according to the invention includes as main parts a hammer 9 for creating a hole 100 in the ground 102, a fluid operated rotation device 50 for rotating the hammer 9 and a drill rod 46 connecting the rotation device 50 to the hammer 9. Fluid pressure may be used to lubricate parts of the hammer, flush the hole and flush out any debris from inside the hammer. The rotation device may be rotated by an electrical motor or it may also be fluid operated. An insertion pipe is normally led behind the drill rod inside the hole.

Figure 2:
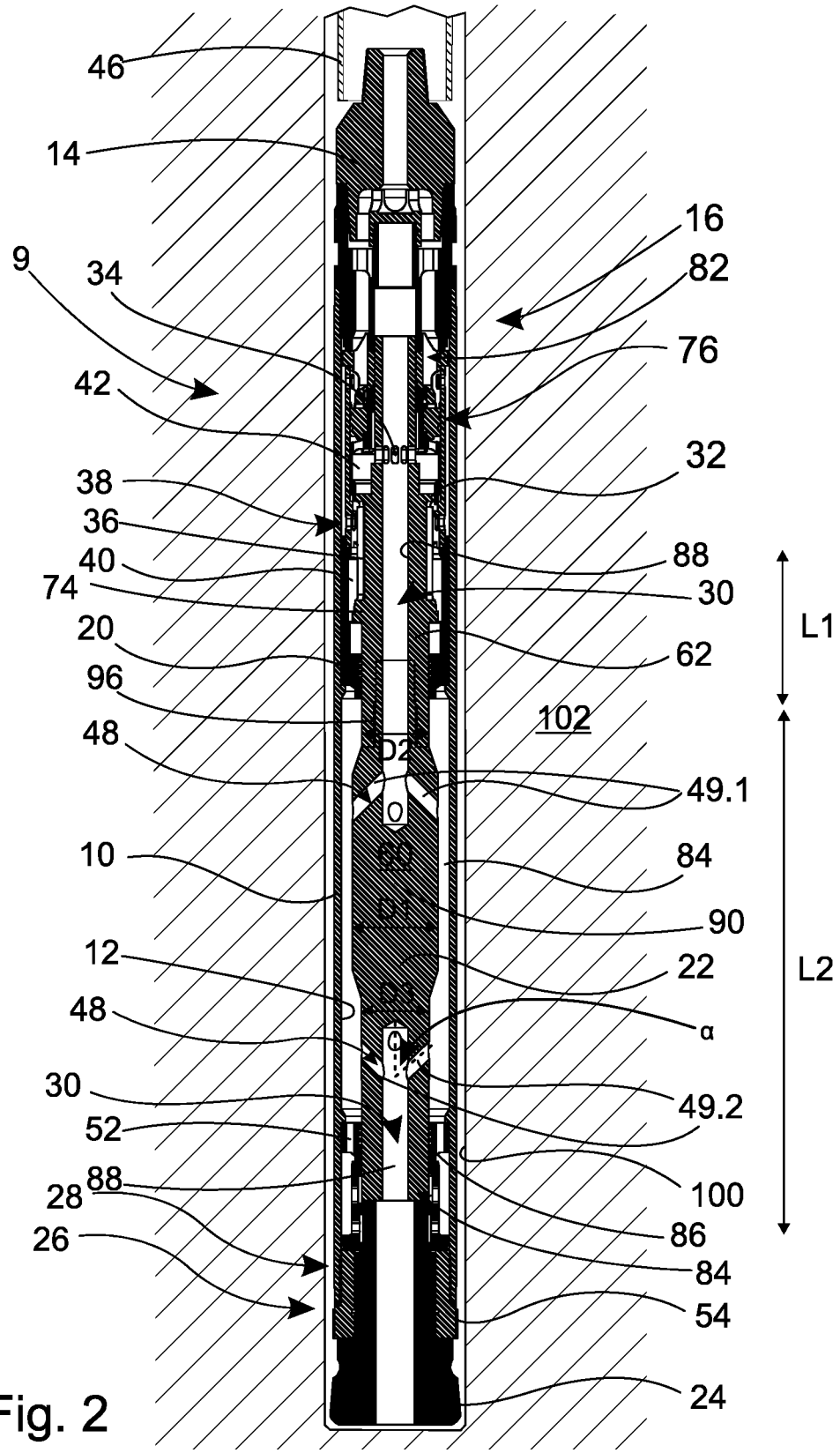
FIG. 2 is a cross-section of the hammer according to an embodiment.

FIG. 2 illustrates an embodiment of the hammer 9 that can be used in the drilling device 1 according to the invention. The hammer 9 comprises a tubular main body 10 having a hollow interior 12, a back head 14 coupled to an upper end 16 of the main body 10 and having a fluid pressure supply passage 18 as well as a cylindrical piston housing 20 connected to the main body 10, preferably inside the main body 10. In addition, the hammer 9 includes a piston 22 installed in the piston housing 20, for striking a drill bit 24 of a bit unit 26 installed at a lower end 28 of the main body 10. The piston 22 is preferably installed and supported slidably inside the piston housing 20. The piston 22 has a hollow portion 30 through which fluid is discharged, a first communication hole 34 connected to the hollow portion 30 and an annular pressurizing portion 32 protruding on piston's outer circumferential surface 36. In the hammer 9 there is a space 38 between the piston 22 and the piston housing 20 divided into a first space portion 40 for elevating the piston 22 and second space portion 42 for striking the piston 22, along the length of the piston 22, the first space portion 40 and the second space portion 42 being alternately connected to the hollow portion 30 of the piston 22 via the first communication hole 34. The movement of the piston 22 and location of the annular pressurizing portion 32 in relation to the first space portion 40 and the second space portion 42 guides the elevation and impact motions of the piston 22.

The piston housing 20 extends only over a partial length L1 of the piston 22. The piston 22 further includes first communication channels 48 between hollow portion 30 of the piston 22 and the main body 10 on the first length L2 of the piston 22 between the piston housing 20 and the bit unit 26 outside partial length L1 for discharging fluid between the piston 22 and the main body 10. To be more precise the first communication channels 48 include upper first communication channels 49.1 for leading the operating fluid from inside the piston 22 to the hollow interior 12 and lower first communication channels 49.2 for leading the operating fluid from hollow interior 12 back inside the piston 22 before the fluid is discharged from the hammer through the bit unit 26. The axial direction of the first communication channels 48 may be at an angle $\alpha$ in relation to the axial direction of the piston 22 which angle is 30-60°, preferably 40-50° in order to decrease pressure losses caused by the change of direction of the fluid flow.

The hammer also includes a valve unit 76 for distributing fluid pressure supply to either the first space portion 40 or the second space portion 42 and a fluid pressure supply unit 44 (see FIG. 1) for supplying high pressure fluid delivered to the fluid pressure supply passage 18 of the back head 14 to the first space portion 40 and the second space portion 42. The valve unit 76 may be a valve unit known from prior art. Preferably fluid used in the drilling device and method according to the invention is water since it is widely available. Fluid used may also be oil, mud or such.

In the drilling device 1 according to FIG. 1, the rotation device 50 rotates the drill rod 46, which then rotates the main body 10 of the hammer. The main body 10 then rotates the drill bit while the piston causes the reciprocating movement of the drill bit 24.

Piston 22 shown in FIG. 2, also known as percussive piston, has in its upper part 62 at least part of the first space portion 40, which can also be called the lifting chamfer area, and at least part of the second space portion 42, which can also be called the striking area. The annular pressurizing portion 32, also known as a chamfer dividing area, is used to separate the first space portion 40 from the second space portion 42. The drilling device according to the invention may incorporate the valve unit 76 elongating the annular pressurizing portion 32 shown in FIGS. 2, 3*a*, 4*a*-4*c* and 5 or alternatively a pilot pressure controlling member connecting to a main valve unit controlling the main flow of the mentioned piston axially by means of effecting alternately the mentioned first space portion and second space portion in order to create a percussive motion of said percussive piston. The piston 22 may include two consecutive parts, a lower part 60 having the first communication channels 48 and an upper part 62 having the annular pressurizing portion 32.

In the invention the size of the first space portion or the second space portion is not limited as they can be elongated. The first space portion can be elongated towards the drill bit and the second space portion towards the main body. However, the annular pressurizing portion 32 is located substantially at the top part of the piston at the piston's operation attitude.

A second diameter D2 in the middle section of the piston 22 makes it possible for the first space portion 40 to lift the piston 22 because the lifting diameter on the annular pressurizing portion 32 is larger than second diameter D2, which diameter difference together with the pressurized operating fluid causes force that lifts the piston up to its striking position. According to one embodiment shown in FIG. 2 the hammer 9 includes a hydraulic braking shoulder 74 which causes a braking effect for the piston 22 when the piston 22 is going forward during impact motion and hydraulic braking shoulder 74 enters into the area of smaller diameter of the piston housing 20. The smaller diameter of the piston housing 20 effectively reduces the power of the lifting force needed when the hammer is lifted from its bottom position after the impact motion has ended.

The piston may also have a first diameter D1 which is preferably larger than second diameter D2. Since the piston 22 is supported only on the second diameter D2, the piston 22 may have a larger first diameter D1 increasing the mass of the piston and a third diameter D3 that may also be equal to or larger than second diameter D2.

Figure 3A:
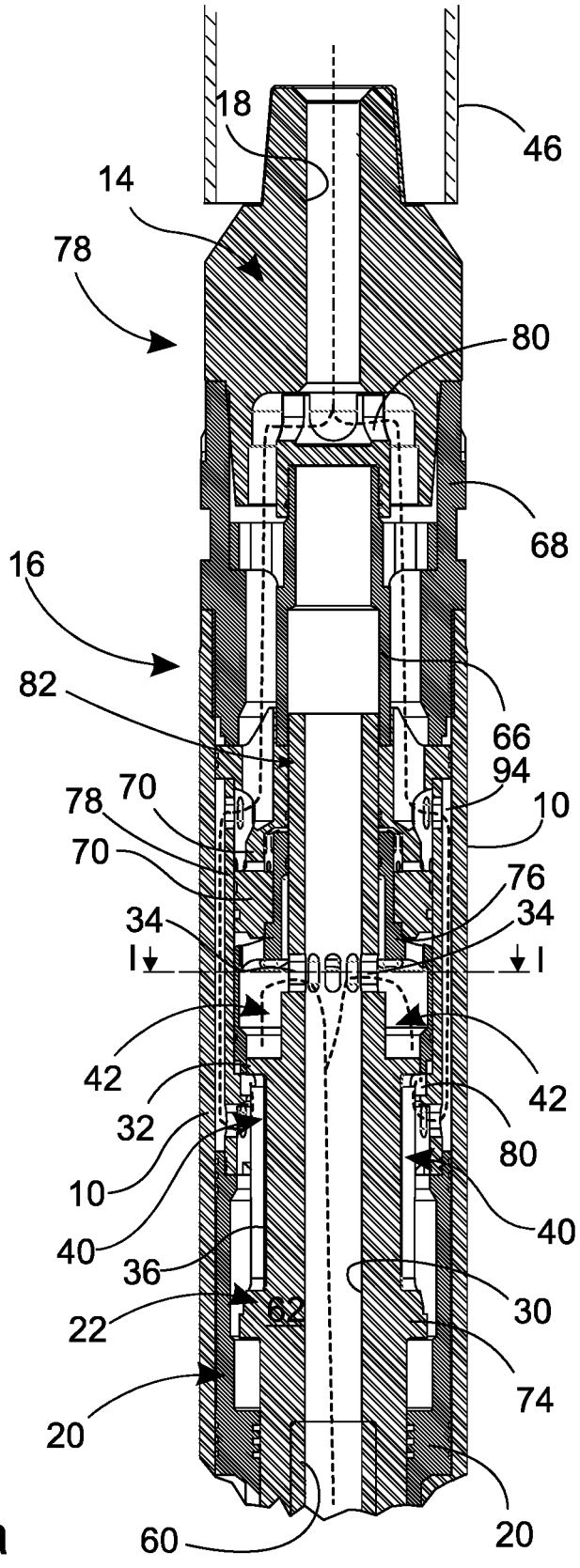
FIG. 3*a* is a enlargement of the lower end of the hammer of FIG. 2.
Figure 3B:
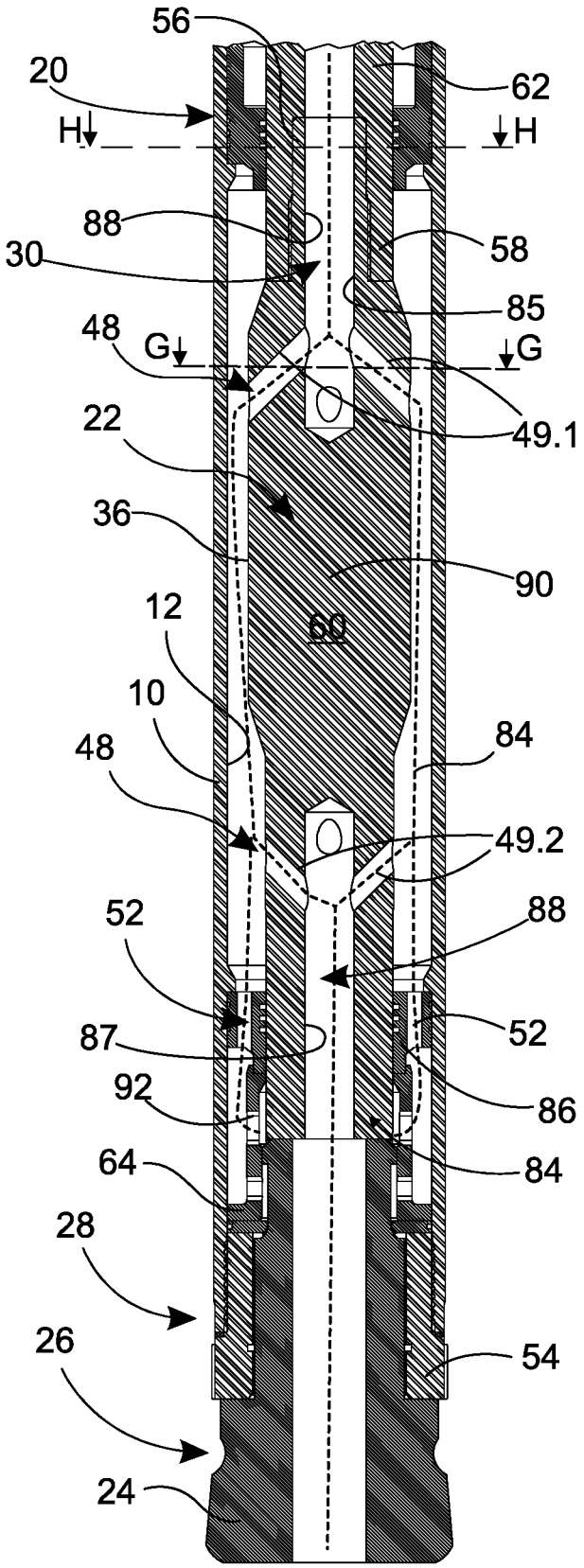
FIG. 3*b* is an enlargement of the upper end of the hammer of FIG. 2, FIGS. 4*a*-4*c* are cross-sectional views of the hammer according to an embodiment in different stages of drilling.

The percussive piston 22 is configured to strike the percussive drill bit 24 of the drill bit unit 26 shown in FIGS. 3*a* and 3*b*. The drill bit unit 26 is attached to the main body 10 of the hammer 9 which is then connected to the drill rod 46 using a back head 14 attached to the hammer 9. The flow of the pressurized fluid is led through the drill rod 46 via the fluid pressure supply passage 18 of the back head 14 inside the hammer 9 to create the pressure of fluid to effect the percussive motion of the percussive piston 22 against percussive drill bit 24. As shown in FIGS. 2-4*c* the piston 22 comprises the lower part 60 assembled to transmit the percussive force to the drill bit 24 and upper part 62 assembled to effect reciprocative action of the percussive piston 22.

The first space portion 40, also known as the lifting chamfer, inside the piston housing 20 is limited by piston housing 20 which seals and centralizes the piston 22. The piston housing 20 effectively limits the first space portion 40 towards the drill bit 24. The piston housing may include a second piston bearing as well as a sealing portion. Discharged fluid is diverted to the outside diameter of the piston 22, i.e. into the hollow interior of the main body 10 somewhere along the piston 22 between piston housing 20 and percussive drill bit 24. According to one preferred embodiment, part of the discharged fluid is transferred at least partially back inside piston 22 to the hollow portion 30 or at least partially through a second communication channel 52 of a piston guide bearing 86, also known as the piston centralizing element. When piston 22 is being elevated backwards after impact motion, discharged fluid fills up a void created by the lifting piston 22 by leading the fluid through the first communication channels 48 and the part of the hollow portion 30 closer to the drill bit 24 as well as through the second communication channels 52 reducing the suction effect of the large piston 22. The second communication channels are not a compulsory part of the hammer, but are a preferable feature.

In the present invention the pressurized area containing the pressurized operating fluid is only between the piston housing and a valve housing 70 (see FIG. 3*a*) in the longitudinal direction of the piston 22. This makes it possible to use large piston diameters below the piston housing even almost as large as the main body's inner diameter if the piston is grooved in its axial direction. The impact force created by the piston is defined by the relation between the diameter of the piston inside the piston housing and the diameter of the piston at the annular pressurizing portion. Preferably the hollow portion 30 of the piston 22 is not continuous through the piston from upper end of the piston 22 to the lower end, but divided into two separate parts 88 by a solid portion 90.

Figure 4A:
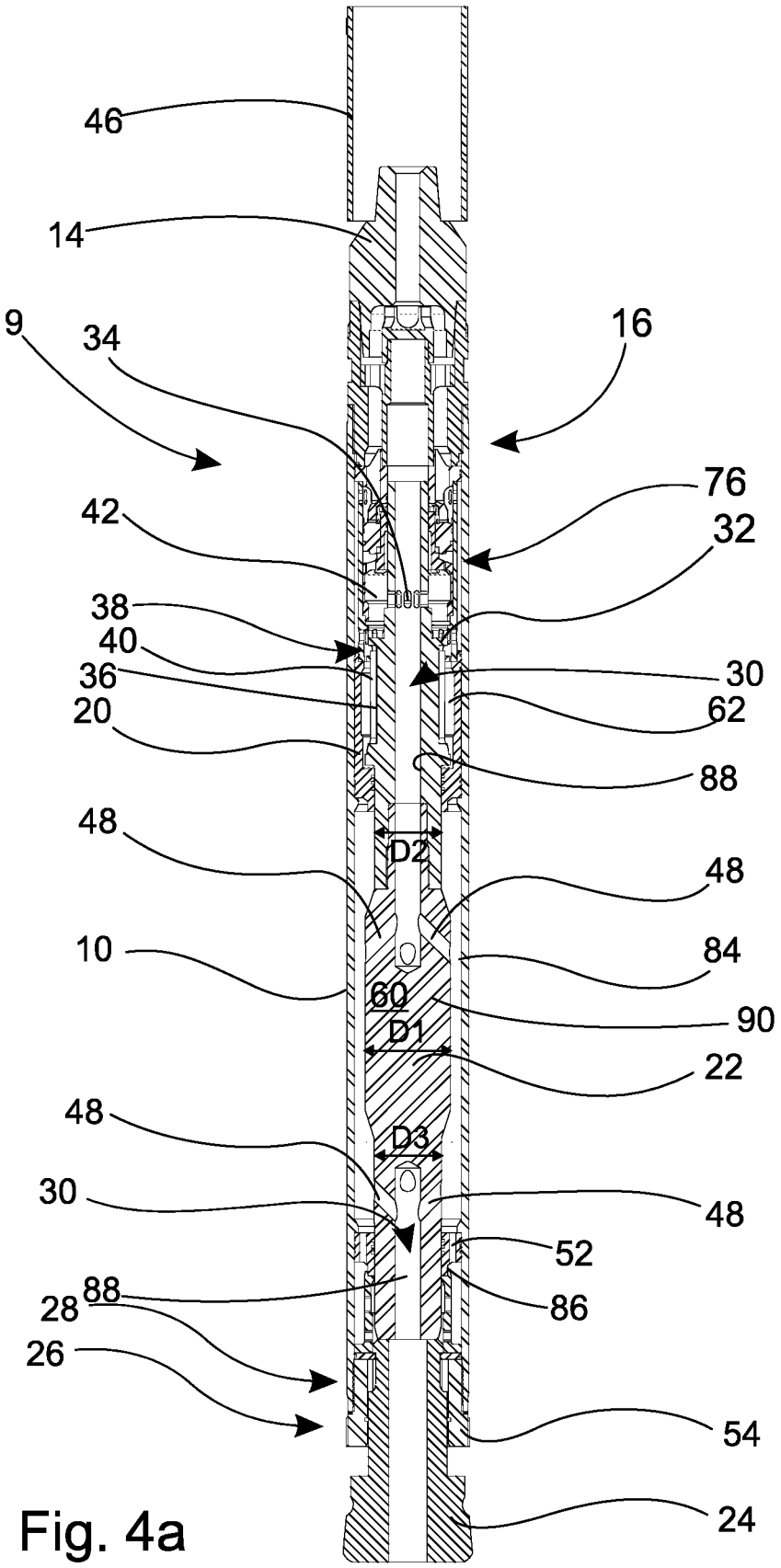
Figure 4B:
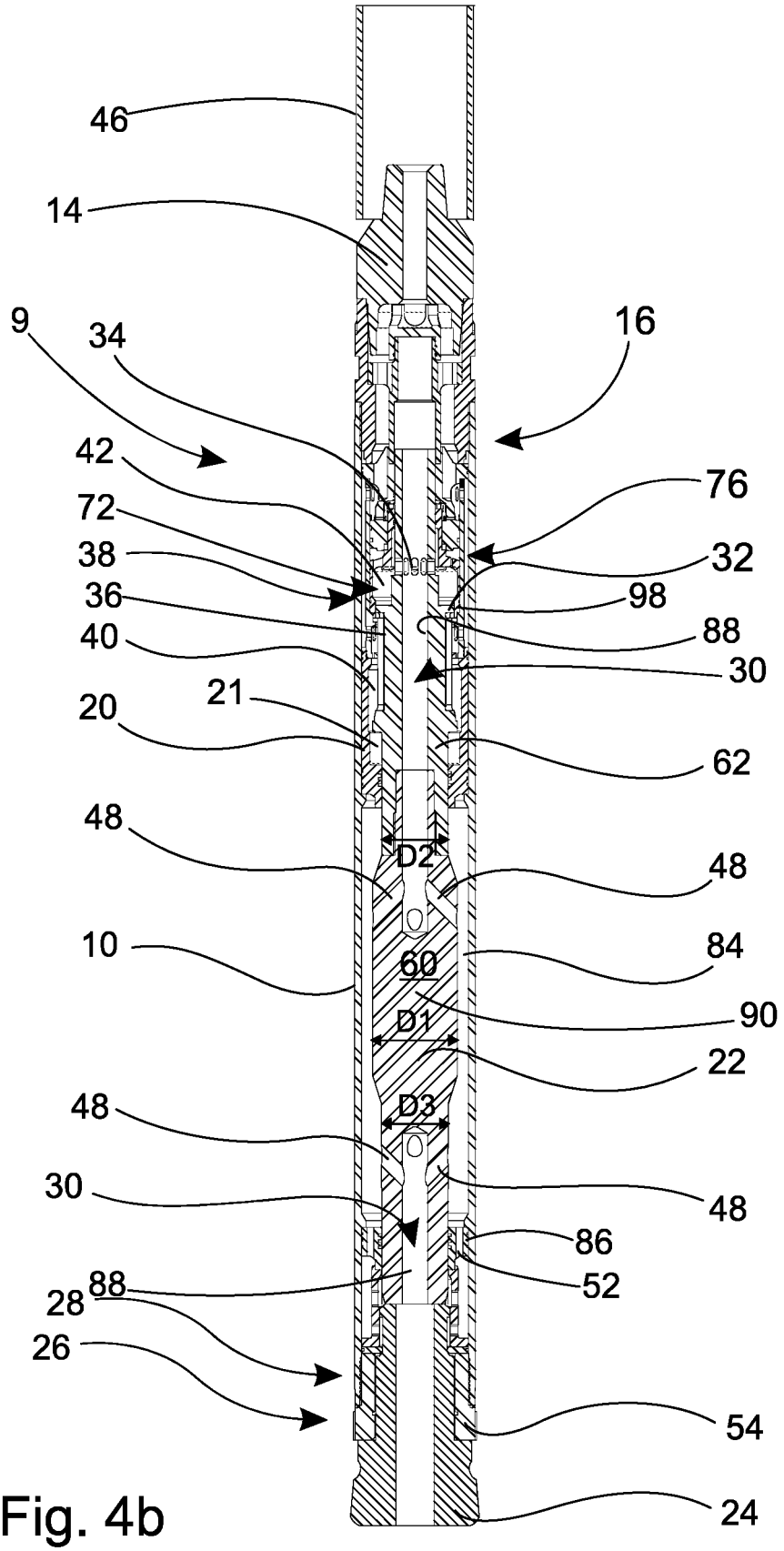
Figure 4C:
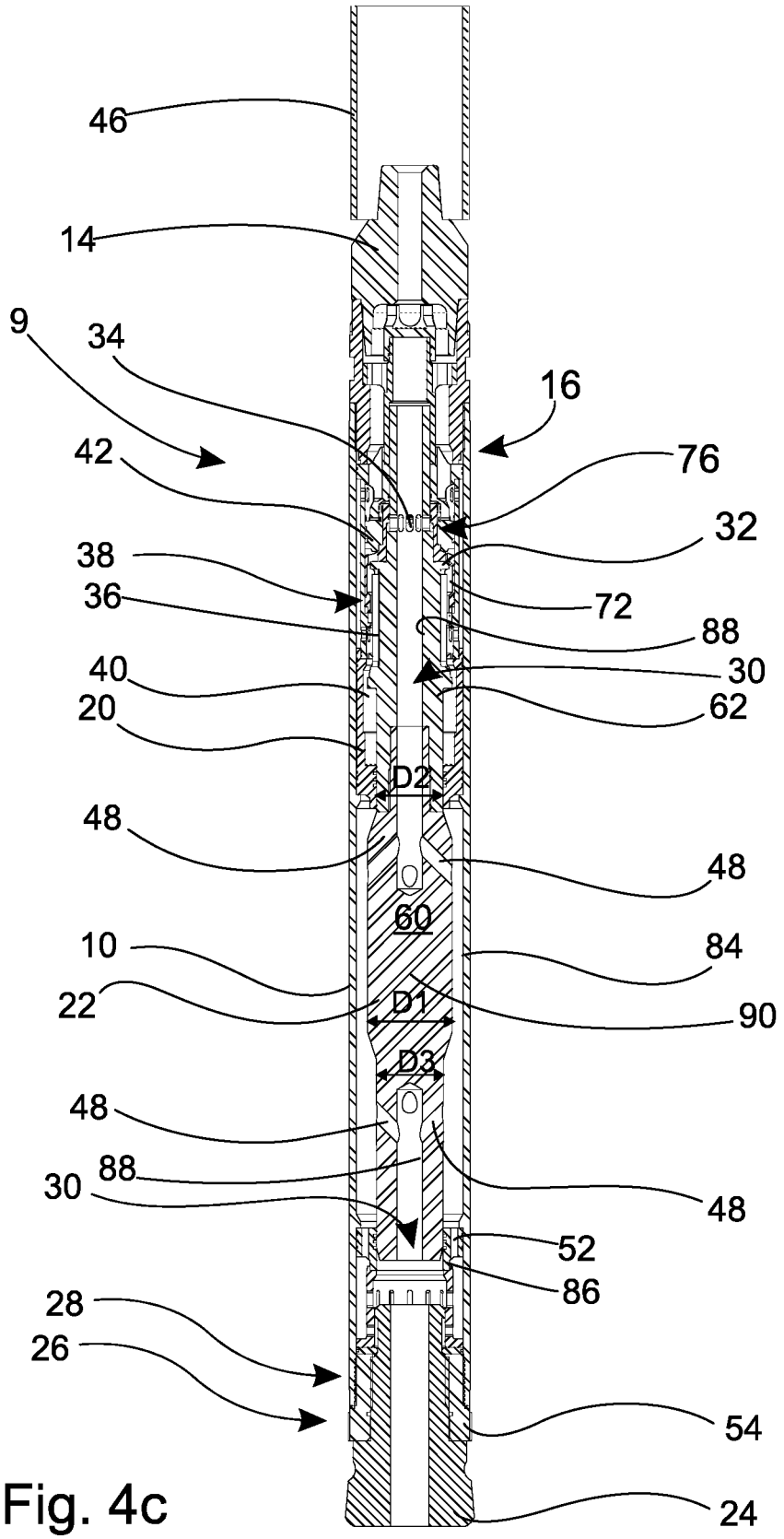
Figure 5:
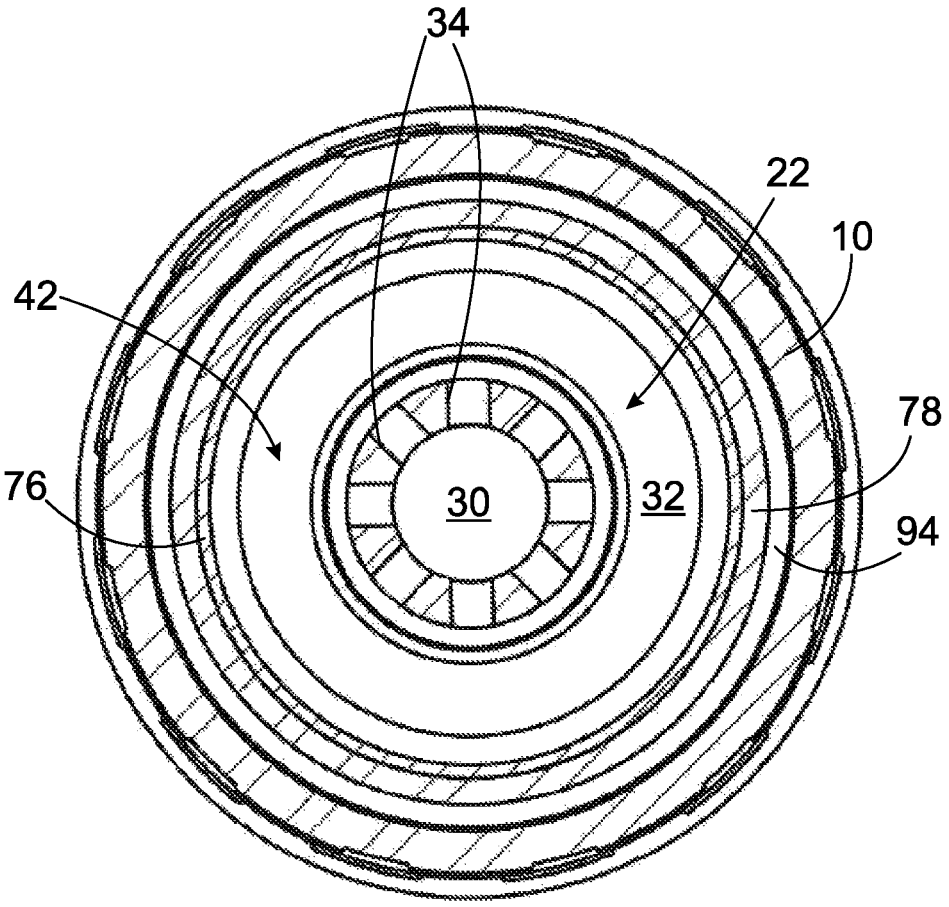
FIG. 5 is a cross section I-I shown in FIG. 3*a*.
Figure 6:
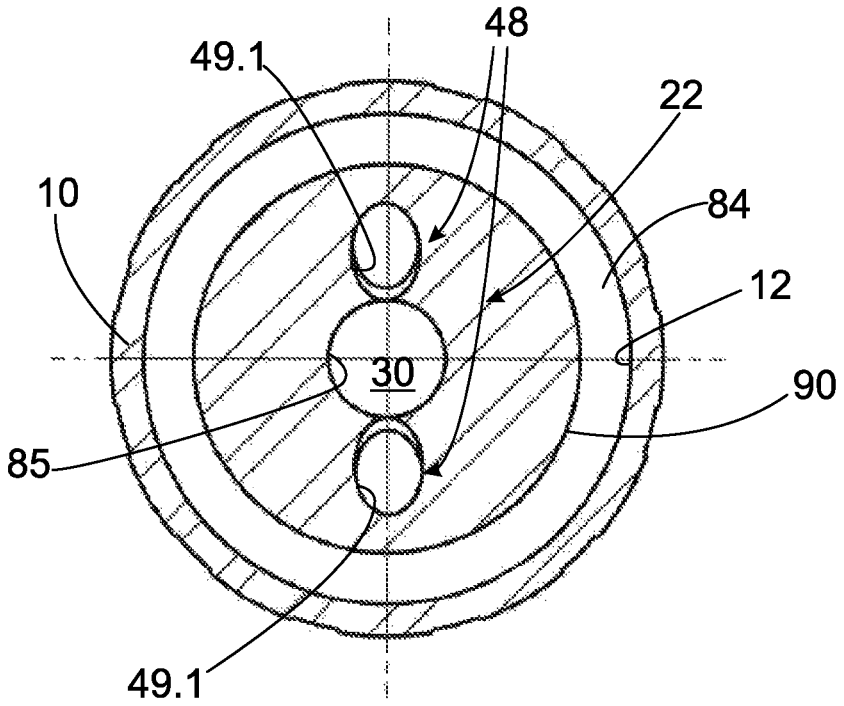
FIG. 6 is a cross section G-G shown in FIG. 3*b*.
Figure 7:
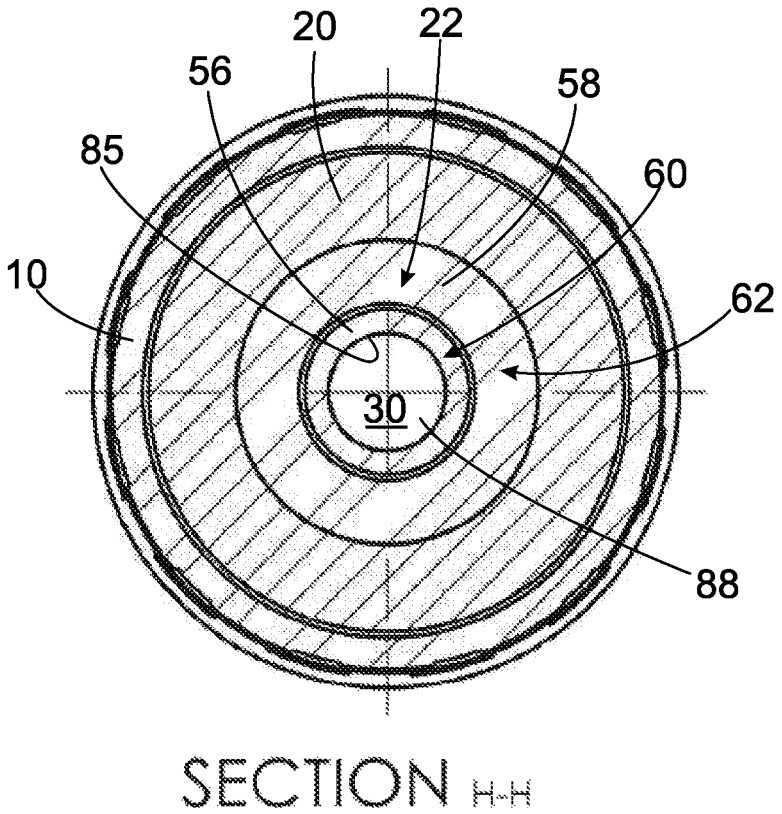
FIG. 7 is a cross section H-H shown in FIG. 3*b*.

The flow path of fluid is disclosed in FIGS. 3*a* and 3*b* with dotted lines whereas FIGS. 4*a*-4*c* show different stages of percussive motion of the hammer. In FIG. 4*a* the hammer 9 is with the drill bit 24 in hang position. All fluid is free to flow through the first communication hole 34 into the hollow portion 30 of the piston 22, so there is no pressure differential and therefore no movement of the piston 22. In FIG. 4*b* the drill bit 24 is in contact with the face of the ground to be drilled and moves upwards. In turn, the piston 22 also moves upwards and the annular pressurizing portion 32 of the piston 22 moves into part 98 of the valve unit 76. Fluid within the valve unit 76 can still flow through the first communication hole 34 into the hollow portion 30 of the piston 22 but now there is a build-up of pressure behind the annular pressurizing portion 32 between the annular pressurizing portion 32 and the hydraulic braking shoulder 74 of the piston 22, driving the piston 22 upwards.

The piston 22 moves upwards and away from the drill bit 24. The piston's 22 first communication hole 34 starts to move into the smaller bore of the valve unit 76 shown in FIG. 4*c*, which in turn stops any fluid within the valve unit 76 going through the first communication hole 34 into the hollow portion 30 of the piston 22, leading to a build-up of pressure inside the valve unit 76. A combination of this pressure build-up within the valve unit 76 and the pressure build-up at the base of the valve unit 76 forces the valve unit 76 to move upwards with the piston 22. The upward momentum of the piston 22 allows the annular pressurizing portion 32 to pass through into the main chamber 72 of the valve unit 76. This in turn relieves the pressure inside the valve unit and the piston 22 starts to decelerate. Also, the hydraulic braking shoulder 74 of the piston 22 passes into the small bore of the piston housing 20 reducing the pressure below this and creating a greater pressure differential at the top end, which starts to drive the piston 22 downwards.

The piston 22 moves downwards towards the drill bit 24. The annular pressurizing portion 32 of the piston 22 moves back into the part 98 of the valve unit 76 shown in FIG. 4*b*. The downward momentum of the piston 22 brings the first communication hole 34 into the main chamber 72 of the valve unit 76, which allows any fluid in the main chamber 72 to flow through the first communication hole 34 into the hollow portion 30 of the piston 22. The piston 22 continues to move downwards towards the drill bit 24. Due to the fluid in the valve unit 76 now being able to flow through the first communication hole 34 into the hollow portion 30 of the piston 22, the valve unit 76 moves downwards along with the piston 22. The hydraulic braking shoulder 74 of the piston 22 moves close to a small diameter of a braking chamber 21 of the piston housing 20 shown in FIG. 4*b*, which has a cushioning effect and decelerates the piston 22. At the end of the cycle the piston 22 strikes the drill bit 24.

The cycle of the percussive motion repeats from the stage wherein the piston is in contact with the drill bit onwards until the hammer is withdrawn, and then the drill bit goes down back into its hang position, resulting in the fluid freely flowing through the first communication hole 34 into the hollow portion 30 of the piston, stopping the shuttling action.

The invention claimed is:

1. A fluid operated drilling device for drilling a hole, the drilling device comprising:

a hammer for creating the hole with a rotating and percussive motion;

a drill rod connected to the hammer; and a rotation device connected to the drill rod for rotating drill rod and the hammer, and transporting operating pressurized drill fluid through the drill rod to the hammer for creating the percussive motion of the hammer, the hammer comprising:

a tubular main body having a hollow interior and an upper end and a lower end;

a back head, for connecting the hammer the drill rod, coupled to the upper end of the main body and having a fluid pressure supply passage;

a cylindrical piston housing; connected to the main body;

a reciprocating piston slidably installed in the piston housing for impacting a drill bit of a bit unit installed at the lower end of the main body, the drill bit being movable for a predetermined length longitudinally relatively to the main body, the piston having a first end a second end, the first end being closer to the drill rod than the second end, a hollow portion through which operating fluid is discharged, a first communication hole connected to the hollow portion and an annular pressurizing portion protruding on an outer circumferential surface of the piston;

a space between the piston and the piston housing divided by the annular pressurizing portion extending in a radial direction of the piston into a first space portion for elevating the piston and a second space portion for striking the piston;

a second space in the hollow interior of the main body between the piston and the main body in the radial direction of the piston and between the piston housing and the bit unit in axial direction of the piston;

first communication channels from the hollow portion of the piston into the second space for discharging the fluid between the piston and the main body;

a valve unit for controlling fluid discharge from the second space portion through the first communication hole to the hollow portion and;

a fluid pressure supply unit for supplying high pressure fluid delivered to the fluid pressure supply passage of the back head alternately to the first space portion and the second space portion;

wherein the rotation device rotates the bit unit using the drill rod and the main body.

2. The drilling device according to claim 1, wherein the piston has at least a first diameter over a first length of the piston between the piston housing and the bit unit outside a partial length of the piston housing, and a second diameter over the partial length limiting the space, wherein a portion of the piston with the first diameter is larger in diameter than the second diameter.

3. The drilling device according to claim 2, wherein the first length of the piston is 40-65% of the total length of the piston and the partial length is 10-25% of the total length of the piston.

4. The drilling device according to claim 2, wherein the first space portion for elevating the piston and the second space portion for striking the piston form piston reciprocating which is located outside the first length of the piston which first length is at the second end of the piston.

5. The drilling device according to claim 1, wherein said piston housing is a single uniform part.

6. The drilling device according to claim 1, wherein the piston comprises a lower part and an upper part detachably connected to each other.

7. The drilling device according to claim 6, wherein both the lower part and the upper part include the hollow portion, and the upper part has the first communication hole and the annular pressurizing portion and the lower part has the first communication channels connected to the hollow portion for leading discharged fluid between the piston and the main body and back inside the piston.

8. The drilling device according to claim 6, wherein the lower part and the upper part of the piston are made of different materials.

9. The drilling device according to claim 1, wherein the first communication channels have an axial direction at an angle in relation to the hollow portion, the angle being 30-60° relative to longitudinal direction of the piston.

10. The drilling device according to claim 1, wherein the hammer comprises a piston guide bearing in connection with the bit unit for supporting the piston and second communication channels arranged in the piston guide bearing to allow a flow of discharged fluid between the piston and the drill bit when the piston is elevated.

11. The drilling device according to claim 2, wherein a majority of a mass of the piston is located on the first length of the piston between the piston housing and the bit unit outside the partial length.

12. The drilling device according to claim 1, wherein the drill bit comprises shoulders or inserts arranged in the drill bit for impacting ground during drilling.

13. The drilling device according to claim 1, wherein the piston is arranged to cooperate with the valve unit for indicating the axial position of the piston relative to the valve unit.

14. The drilling device according to claim 1, wherein the hollow portion is discontinuous through the piston and includes two consecutive parts comprising an upper flow channel and a lower exhaust channel separated by a solid portion belonging to the piston.

15. The drilling device according to claim 14, wherein each part of the hollow portion has first communication channels for guiding discharged fluid into the second space from the upper flow channel and back inside the piston in the lower exhaust channel closer to the bit unit for leading the discharged fluid to the bit unit.

16. The drilling device according to claim 14, wherein the lower exhaust channel is open to the bit unit.

17. The drilling device according to claim 1, wherein a longitudinal length of the first space portion is 10-30% of a length of the piston.

18. The drilling device according to claim 2, wherein the piston housing extends only over the partial length of the piston forming the second space in the hollow interior of the main body.

19. The drilling device according to claim 1, wherein the first communication channels include upper communication channels from the hollow portion of the piston into the second space for discharging fluid between the piston and the main body and lower communication channels from the second space into the hollow portion of the piston for discharging fluid from the piston through the bit unit.

20. A method for drilling a hole using a fluid operated drilling device, which method includes steps of pressurizing pressurized operating fluid with a fluid pressure supply unit;

rotating a drill rod and a percussive hammer attached to the drill rod with a rotation device, leading pressurized operating fluid to a percussive hammer through the drill rod;

using pressurized operating fluid in the percussive hammer to alternately elevate and impact a percussive piston by pressurizing a first space portion inside a piston housing to elevate the piston and second space portion inside the piston housing to impact the piston to cause the percussive motion of a drill bit axially movably on the piston;

guiding operating fluid discharged from the first space portion and the second space portion outside the piston to flush and lubricate a hollow interior of a main body between the piston and the main body of the hammer outside the piston housing; and guiding operating fluid discharged to the hollow interior back inside the piston before guiding the operating fluid through a bit unit.

* * * * *